US005510220A

United States Patent [19]

Nash et al.

[11] Patent Number: 5,510,220

[45] Date of Patent: Apr. 23, 1996

[54] CONDUCTIVE DEVELOPER COMPOSITIONS WITH SURFACE ADDITIVES

[75] Inventors: Robert J. Nash, Webster; Cheryl A. Hanzlik, Fairport; Richard N. Muller, Penfield; Richard J. Hodgson, Rochester, all of N.Y.

[73] Assignee: Xerox Corporation, Stamford, Conn.

[21] Appl. No.: 379,838

[22] Filed: Jan. 27, 1995

[51] Int. Cl.[6] ..... G03G 9/10; G03G 9/097

[52] U.S. Cl. ..... 430/106; 430/108; 430/109; 430/110; 430/126

[58] Field of Search ..... 430/108, 109, 430/110, 126, 106

[56] References Cited

U.S. PATENT DOCUMENTS

| | | | |
|---|---|---|---|
| H1247 | 11/1993 | Nash et al. | 430/108 |
| 3,635,704 | 1/1972 | Palermiti et al. | 96/1 |
| 3,900,587 | 8/1975 | Lenhard et al. | 427/19 |
| 3,983,045 | 9/1976 | Jugle et al. | 252/62.1 P |
| 4,557,991 | 12/1986 | Takagiwa et al. | 430/109 |
| 4,997,739 | 3/1991 | Tomono et al. | 430/110 |
| 5,227,460 | 7/1993 | Mahabadi et al. | 528/272 |
| 5,397,667 | 3/1995 | Law et al. | 430/110 |
| 5,451,481 | 9/1995 | Law et al. | 430/110 |

*Primary Examiner*—Tae Yoon
*Attorney, Agent, or Firm*—E. O. Palazzo

[57] ABSTRACT

A developer composition comprised of negatively charged toner particles comprised of crosslinked polyester resin particles, pigment particles, and a surface additive mixture comprised of metal salts of fatty acids in an amount of from about 0.2 to about 0.5 weight percent, metal oxide particles in an amount of from about 0.3 to about 1 weight percent, and silica particles in an amount of from about 0.2 to about 0.5 weight percent; and carrier particles comprised of a core with a coating thereover containing a conductive component.

29 Claims, No Drawings

CONDUCTIVE DEVELOPER COMPOSITIONS WITH SURFACE ADDITIVES

BACKGROUND OF THE INVENTION

This invention is generally directed to toner and developer compositions, and more specifically, the present invention is directed to toner compositions with surface additives. In embodiments the present invention is directed to negatively charged conductive magnetic brush toners comprised of polyester resins, especially certain crosslinked extruded polyesters, pigment, and specific surface additives of, for example, metal salts of fatty acids, and silica particles, such as fumed silicas available from Cabot Corporation as TS530®, which additives are present in certain important amounts, reference for example copending patent application U.S. Ser. No. 379,821, the disclosure of which is totally incorporated herein by reference. Also, the toner in embodiments may contain in certain important amounts a third additive of metal oxides, preferably titanium oxide ($TiO_2$). Further, in embodiments the present invention relates to negatively charged conductive magnetic brush toners especially suitable for hybrid jumping development, which toners are comprised of polyester resins, especially certain crosslinked extruded polyesters, carbon black pigment, and specific surface additives of a mixture of fumed colloidal silica particles and metal salts of fatty acids, preferably zinc stearate, which additives are present in certain important amounts such as for each additive about 0.2 to about 0.5 weight percent. The developer for the aforementioned toners is comprised of carrier coated with a polymer, such as polymethylmethacrylate, and wherein the coating contains a conductive component like carbon black, such VULCAN 72R® available from Cabot Corporation. The toner and developer compositions of the present invention are useful in a number of known electrostatographic, such as xerographic, imaging and printing systems including printing methods with lasers.

In embodiments, the conductive magnetic brush developers of the present invention can be selected for hybrid jumping development, hybrid scavengeless development, and similar processes, reference U.S. Pat. Nos. 4,868,600; 5,010,367; 5,031,570; 5,119,147; 5,144,371; 5,172,170; 5,300,992; 5,311,258; 5,212,037; 4,984,019; 5,032,872; 5,134,442; 5,153,647; 5,153,648; 5,206,693; 5,245,392; 5,253,016, the disclosures of which are totally incorporated herein by reference. The aforementioned developers, which can contain a negatively charging toner, are suitable for use with laser or LED printers, discharge area development with layered flexible photoconductive imaging members, reference U.S. Pat. No. 4,265,990, the disclosure of which is totally incorporated herein by reference, and organic photoconductive imaging members with a photogenerating layer and a charge transport layer on a drum, light lens xerography, charged area development on, for example, inorganic photoconductive members such as selenium, selenium alloys like selenium, arsenic, tellurium, hydrogenated amorphous silicon, trilevel xerography, reference U.S. Pat. Nos. 4,847,655; 4,771,314; 4,833,540; 4,868,608; 4,901,114; 5,061,969; 4,948,686 and 5,171,653, the disclosures of which are totally incorporated herein by reference, full color xerography, and the like, reference for example the Xerox Corporation 4850®. In embodiments, the developers of the present invention are preferably selected for imaging and printing systems with conductive magnetic brush development as illustrated, for example, in U.S. Pat. No. 4,678,734, the disclosure of which is totally incorporated herein by reference, and wherein there is enabled in embodiments high development levels, development to substantially complete neutralization of the photoreceptor image potential, development of low levels of image potentials and increased background suppression. Further, the toners of the present invention are free of charge enhancing additives like cetyl pyridinium chloride, thereby minimizing or avoiding environmental problems; and moreover no wax is present with the developers of the present invention, thereby avoiding wax escape and smudging of the developed images.

With the developers of the present invention wax, such as low molecular weight waxes like polypropylene, or polyethylene, and charge additives are avoided; low melting polyesters are selected as the toner resin permitting, for example, lower fuser energies; and the toner size is, for example, from about 7 to about 15 and preferably 9 microns in average volume diameter as determined by a Coulter Counter and narrow GSD in embodiments, for example about 1.3. Additionally, the developers of the present invention in embodiments enable high levels of toner flow, for example from about 7 to about 10 grams per minute, rapid admix of, for example, about 30, and preferably 15 seconds or less, as determined by the charge spectrograph, a toner tribo of from about −15 to about −25 with the two additives, and from about −6 to about −12 for three additives, and high levels of developer conductivity, for example $10^{-8}$ (ohm-cm)$^{-1}$ at a 3 percent toner concentration. Moreover, in embodiments the surface additive of a fatty acid salt like zinc stearate functions primarily as a conductivity component and the fumed silica functions primarily as a flow aid, toner blocking avoidance component, and for assistance in achieving excellent admix characteristics. The third surface additive of metal oxides, like titanium dioxide, in the surface mixture assists in achieving a combination of excellent toner flow, superior admix, and acceptable blocking characteristics, and moreover, the three surface additive mixture assists in controlling the tribocharge of the toner.

Toner and developers with toner additives like wax and surface additives of, for example, metal oxides, and colloidal silicas are known. Toners with polyesters, including extruded polyesters, are also known, reference U.S. Pat. No. 5,227,460, the disclosure of which is totally incorporated herein by reference. In U.S. Pat. No. 4,795,689, there is disclosed an electrostatic image developing toner comprising as essential constituents a nonlinear polymer, a low melting polymer, which is incompatible with the nonlinear polymer, a copolymer composed of a segment polymer, which is at least compatible with the nonlinear polymer, and a segment polymer, which is at least compatible with the low melting polymer, and a coloring agent, see the Abstract, and columns 3 to 10 for example; and U.S. Pat. No. 4,557,991 discloses a toner for the development of electrostatic images comprised of a certain binder resin, and a wax comprising a polyolefin, see the Abstract; also see columns 5 and 6 of this patent and note the disclosure that the modified component shows an affinity to the binder and is high in compatibility with the binder, column 6, line 25.

Developer and toner compositions with certain waxes therein, are known. For example, there are illustrated in U.K. Patent Publication 1,442,835, the disclosure of which is totally incorporated herein by reference, toner compositions containing resin particles, and polyalkylene compounds, such as polyethylene and polypropylene of a molecular weight of from about 1,500 to about 20,000, reference page 3, lines 97 to 119, which compositions prevent toner offsetting in electrostatic imaging processes. Additionally, the '835 publication discloses the addition of paraffin waxes together with, or without a metal salt of a fatty acid, reference page 2, lines 55 to 58. Also, in U.S. Pat. No. 4,997,739, there is illustrated a toner formulation including polypropylene wax ($M_w$: from about 200 to about 6,000) to improve hot offset. In addition, many patents disclose the use of metal salts of fatty acids for incorporation into toner compositions, such as U.S. Pat. No. 3,655,374. Also, it is known that the aforementioned toner compositions with metal salts of fatty acids can be selected for electrostatic imaging methods wherein blade cleaning of the photoreceptor is accomplished, reference U.S. Pat. No. 3,635,704, the disclosure of which is totally incorporated herein by reference. Additionally, there are illustrated in U.S. Pat. No. 3,983,045 developer compositions comprising toner particles, a friction reducing material, and a finely divided nonsmearable abrasive material, reference column 4, beginning at line 31. Examples of friction reducing materials include saturated or unsaturated, substituted or unsubstituted, fatty acids preferably of from 8 to 35 carbon atoms, or metal salts of such fatty acids; fatty alcohols corresponding to said acids; mono and polyhydric alcohol esters of said acids and corresponding amides; polyethylene glycols and methoxy-polyethylene glycols; terephthalic acids; and the like, reference column 7, lines 13 to 43. Toners with colloidal silicas, like AEROSIL® are also known.

Described in U.S. Pat. No. 4,367,275 are methods of preventing offsetting of electrostatic images of the toner composition to the fuser roll, which toner subsequently offsets to supporting substrates, such as papers, wherein there is selected toner compositions containing specific external lubricants including various waxes, see column 5, lines 32 to 45.

There are various problems observed with the inclusion of polyolefin or other waxes in toners. For example, when a polypropylene wax is included in toner to enhance the release of toner from a hot fuser roll, or to improve the lubrication of fixed toner image it has been observed that the wax does not disperse well in the toner resin. As a result, free wax particles are released during the pulverizing step in, for example, a fluid energy mill and the pulverization rate is lower. The poor dispersion of wax in the toner resin and, therefore, the loss of wax will then impair the release function it is designed for. Scratch marks, for example, on xerographic developed toner solid areas caused by stripper fingers were observed as a result of the poor release. Furthermore, the free wax remaining in the developer will build up on the detone roll present in the xerographic apparatus causing a hardware failure. With the toners of the present invention, a wax is not present thereby avoiding or minimizing the aforementioned problems.

Illustrated in copending U.S. patent application Ser. Nos. 331,444 and 331,441, the disclosures of which are totally incorporated herein by reference, are toners with surface additive mixtures of silica, polyvinylidene fluoride, a KYNAR®, and strontium titanate.

Illustrated in copending U.S. patent application Ser. No. 379,822, filed concurrently herewith, is a developer composition comprised of negatively charged toner particles comprised of crosslinked polyester resin particles, pigment particles, and a surface additive mixture comprised of metal salts of fatty acids in an amount of from about 0.2 to about 0.5 weight percent, and silica particles in an amount of from about 0.2 to about 0.5 weight percent; and carrier particles comprised of a core with a coating thereover containing a conductive component; U.S. Ser. No. 379,822, filed concurrently herewith, illustrates a developer composition comprised of a negatively charged toner composition comprised of crosslinked polyester resin particles, pigment particles, wax component particles, a compatibilizer and a surface additive mixture comprised of metal salts of fatty acids, silica particles and metal oxide particles; and carrier particles comprised of a core with a polymer coating or mixture of polymer coatings; and wherein said coating or coatings contain a conductive component; and U.S. Ser. No. 379,224, filed concurrently herewith, illustrates an insulating developer composition comprised of resin particles, pigment particles, wax component particles, compatibilizer, and a surface additive mixture comprised of metal salts of fatty acids, silica particles, and metal oxide particles; and carrier particles comprised of a ferrite core with a polymer coating or mixture of polymer coatings; and wherein said developer is of a conductivity of from about $10^{-14}$ to about $10^{-16}$ $(\text{ohm-cm})^{-1}$, the disclosures of which are totally incorporated herein by reference.

SUMMARY OF THE INVENTION

Examples of objects of the present invention include the following.

It is an object of the present invention to provide toner and developer compositions which possess many of the advantages indicated herein.

Another object of the present invention resides in the provision of toner and developer compositions with stable negatively charged triboelectrical characteristics for extended time periods.

In another object of the present invention there are provided toner and developer compositions with certain surface additives in important amount ranges.

Additionally, another object of the present invention relates to the provision of high developer conductivity, for example $10^{-8}$ $(\text{ohm-cm})^{1}$ as determined in a conductivity cell, reference U.S. Pat. No. 5,196,803, the disclosure of which is totally incorporated herein by reference, conductive toner and developer compositions especially suitable for discharged area development, and wherein in embodiments the toned developer conductivity at, for example, 3 percent toner concentration is in the range of $10^{-8}$ $(\text{ohm-cm})^{-1}$, the developer tribo is from about −8 to about −25 microcoulombs per gram, the toner possesses rapid admix characteristics, for example less than 60, and preferably 15 seconds as determined in a charge spectrograph, and there is enabled a high level of developer flow, for example 20 to 25 grams per minute in a flow tube tester.

Further, another object of the present invention relates to the provision of highly conductive developer compositions especially suitable for discharged area development, and wherein in embodiments the toned developer conductivity at, for example, 3 percent toner concentration is in the range of $10^{-8}$ $(\text{ohm-cm})^{-1}$, and the developer tribo is from about −8 to about −12 microcoulombs per gram, the toner possesses rapid admix characteristics, for example less than 60, and preferably 15 seconds as determined in a charge spectrograph, and wherein the toner selected contains a mixture of surface additives comprised of silica, and metal salts of fatty acids.

Moreover, in another object of the present invention there are provided toner and developer compositions with certain additives thereon and mixed with certain carriers, and which toners can be selected for xerographic imaging processes inclusive of trilevel, conductive magnetic brush, hybrid jumping development as indicated herein.

These and other objects of the present invention can be accomplished in embodiments by providing specific improved toner and developer compositions. More specifically, the present invention is directed to negatively charged toner compositions comprised of crosslinked polyester resin particles, pigment particles, and surface additives, and a developer thereof with carrier particles comprised of a core with a coating thereover.

In embodiments of the present invention, there are provided negatively charged toner compositions comprised of extruded polyester resin particles, preferably with a gel content of from about 25 to about 34 and preferably about 29 percent, pigment particles, especially carbon black, and surface additives comprised of a mixture of metal salts of fatty acids like zinc stearate, metal oxides, and silica particles, and wherein each of the aforementioned surface additives are present in an amount of from about 0.1 to about 1 and preferably from about 0.3 to about 0.4 weight percent, and wherein the developer is comprised of the aforementioned toners and carrier particles comprised of a core, preferably steel, solution coated with polymethylmethacrylate, and which coating contains a conductive component like carbon black, preferably VULCAN 72R® carbon black in an amount, for example, of from about 20 to about 50 weight percent and preferably about 20 weight percent and available from Cabot Corporation. The aforementioned developers are especially useful in conductive magnetic brush xerographic imaging methods.

In embodiments the present invention is directed to a developer composition comprised of negatively charged toner particles comprised of crosslinked polyester resin particles, pigment particles, and a surface additive mixture comprised of metal salts of fatty acids in an amount of from about 0.2 to about 0.5 weight percent, metal oxide particles in an amount of from about 0.3 to about 1 weight percent, and silica particles in an amount of from about 0.2 to about 0.5 weight percent, and carrier particles comprised of a core with a coating thereover containing a conductive component; and a developer composition comprised of negatively charged toner particles comprised of crosslinked polyester resin particles, carbon pigment particles, and a surface additive mixture comprised of metal salts of fatty acids in an amount of from about 0.3 to about 0.4 weight percent, titanium oxide particles in an amount of from about 0.3 to about 1 weight percent, and fumed silica particles in an amount of from about 0.3 to about 0.4 weight percent, and carrier particles comprised of a core with a polymer coating thereover containing a conductive component.

Also, in embodiments of the present invention there are provided negatively toner compositions comprised of extruded polyester resin particles, preferably with a gel content of from about 25 to about 34 and preferably about 29 percent, pigment particles, especially carbon black, and surface additives comprised of a mixture of metal salts of fatty acids like zinc stearate, metal oxides like titanium oxide, and fumed silica particles, and wherein each of the aforementioned surface additives are present in an amount of from about 0.1 to about 1 and preferably from about 0.2 to about 0.4 weight percent, and wherein the developer is comprised of the aforementioned toners and carrier particles comprised of a core, preferably steel, solution coated with a polymer, such as polymethylmethacrylate and which coating contains a conductive component like carbon black, preferably VULCAN 72R® carbon black available from Cabot Corporation. Preferably, in embodiments the extruded crosslinked polyester is present in an amount of 94 weight percent, the pigment carbon black is present in an amount of 6 weight percent, the zinc stearate is present in an amount of 0.4 weight percent, the fumed silica TS530® is present in an amount of 0.4 weight percent, and the titanium oxide or dioxide is present in an amount of 1 weight percent; the carrier is comprised of Hoeganese unoxidized core, 98 microns, solution coated with about 1 percent of an 80/20 lacquer of polymethylmethacrylate/VULCAN 72R® carbon black obtained from Cabot Corporation. The toner concentration can vary and preferably is from about 2 to about 6 weight percent.

For one developer preferably 0.4 weight percent of zinc stearate and 0.4 weight percent of colloidal silica TS530® particles are selected and wherein preferably 94 weight percent of an extruded polyester, 94 weight percent with a 29 percent gel content, resin, 6 weight percent of carbon black, especially REGAL 330®, 98 micron diameter Hoeganese steel carrier core solution coated with 1 percent of an 80/20 lacquer of polymethylmethacrylate with VULCAN 72R® carbon black dispersed therein, and wherein the toner concentration is 3 percent, that is 3 parts of toner for each 100 parts of carrier are selected.

For another developer preferably 0.4 weight percent of zinc stearate, 1.0 weight percent of titanium oxide, and 0.4 weight percent of colloidal silica particles are selected, and wherein preferably 94 weight percent of an extruded polyester, 94 weight percent with a 29 percent gel content, resin, 6 weight percent of carbon black, especially REGAL 330®, 98 micron diameter Hoeganese steel carrier core solution coated with from about 0.75 to about 1 percent of an 80/20 lacquer of polymethylmethacrylate with VULCAN 72R® carbon black dispersed therein, and wherein the toner concentration is 3 percent, that is 3 parts of toner for each 100 parts of carrier are selected.

Illustrative examples of suitable toner resins for the toners of the present invention include polyesters, especially the polyesters of U.S. Pat. No. 5,227,460, the disclosure of which is totally incorporated herein by reference. These polyester resins can be prepared by a reactive resin such as, for example, wherein an unsaturated linear polyester resin is crosslinked in the molten state under high temperature and high shear conditions, preferably using a chemical initiator such as, for example, organic peroxide as a crosslinking agent, in a batch or continuous melt mixing device without forming any significant amounts of residual materials. Thus, the removal of byproducts or residual unreacted materials is not needed with embodiments of the process of the invention. In preferred embodiments of this process, the base resin and initiator are preblended and fed upstream to a melt mixing device, such as an extruder at an upstream location, or the base resin and initiator are fed separately to the melt mixing device, like an extruder at either upstream or downstream locations. An extruder screw configuration, length and temperature may be used which enable the initiator to be well dispersed in the polymer melt before the onset of crosslinking, and further which provide a sufficient, but short, residence time for the crosslinking reaction to be carried out. Adequate temperature control enables the crosslinking reaction to be carried out in a controlled and reproducible fashion. Extruder screw configuration and length can also provide high shear conditions to distribute microgels formed during the crosslinking reaction well in the polymer melt, and to keep the microgels from inordinately increasing in size with increasing degree of crosslinking. An optional devolatilization zone may be used to remove any volatiles, if needed. The polymer melt may then be pumped through a die to a pelletizer. One suitable type of extruder is the fully intermeshing corotating twin screw extruder such as, for example, the ZSK-30 twin screw extruder available from Werner & Pfleiderer Corporation, Ramsey, N.J., U.S,A., which has a screw diameter of 30.7 millimeters and a length-to-diameter (L/D) ratio of 37.2. The extruder can melt the base resin, mix the initiator into the base resin melt, provide high temperature and adequate residence time for the crosslinking reaction to be accomplished, control the reaction temperature via appropriate temperature control along the extruder channel, optionally devolatilize the melt to remove any effluent volatiles if needed, and pump the crosslinked polymer melt through a die such as, for example, a strand die to a pelletizer. For chemical reactions in highly viscous materials, reactive extrusion is particularly efficient, and is advantageous because it requires no solvents, and thus is easily environmentally controlled. It is also advantageous because it permits a high degree of initial mixing of base resin and initiator to take place, and provides an environment wherein a controlled high temperature (adjustable along the length of the extruder) is available so that a very quick reaction can occur. It also enables a reaction to take place continuously, and thus the reaction is not limited by the disadvantages of a batch process, wherein the reaction must be repeatedly stopped so that the reaction products may be removed and the apparatus cleaned and prepared for another similar reaction. As soon as the desired amount of crosslinking is achieved, the reaction products can be quickly removed from the reaction chamber.

The crosslinked resin produced comprises crosslinked gel particles and a noncrosslinked or linear portion, but substantially no sol. The gel content of the crosslinked resin ranges from about 0.001 to about 50 percent by weight, and preferably from about 0.1 to about 40 or 10 to 19 percent by weight, wherein the gel content is defined as follows $$\text{Gel Content} = \frac{\text{Total Sample Weight} - \text{Weight of Soluble Polymer}}{\text{Total Sample Weight}} \times 100\%$$

There is substantially no crosslinked polymer which is not gel, that is, low crosslink density polymer or sol, as would be obtained in conventional crosslinking processes such as, for example, polycondensation, bulk, solution, suspension, emulsion and suspension polymerization processes.

The crosslinked portions of the crosslinked polyester resin are comprised of very high molecular weight microgel particles with high density crosslinking (as measured by gel content), and which are not soluble in substantially any solvents such as, for example, tetrahydrofuran, toluene and the like. The microgel particles are highly crosslinked polymers with a short crosslink distance of zero or a maximum of one atom such as, for example, oxygen.

The linear portions of the crosslinked resin have substantially the same number average molecular weight ($M_n$), weight-average molecular weight ($M_w$), molecular weight distribution ($M_w/M_n$), onset glass transition temperature ($T_g$) and melt viscosity as the base resin. Thus embodiments of the entire crosslinked resin have an onset glass transition temperature of from about 50° C. to about 70° C., and preferably from about 51° C. to about 60° C., and a melt viscosity of from about 5,000 to about 200,000 poise, and preferably from about 20,000 to about 100,000 poise at 100° C., and from about 10 to about 20,000 poise at 160° C.

Numerous well known suitable pigments can be selected as the colorant for the toner particles including, for example, carbon black like REGAL 330®, BLACK PEARLS®, and other carbon blacks available from Cabot Corporation. The carbon black should be present in a sufficient amount to render the toner composition colored thereby permitting the formation of a clearly visible image. Generally, the carbon black particles are present in amounts of from about 2 percent by weight to about 20 percent by weight, and preferably from about 5 to about 10 weight percent, based on the total weight of the toner composition, however, lesser or greater amounts of pigment particles may be selected in embodiments.

Examples of surface additives for the toner include metal salts of fatty acids like magnesium stearate, zinc stearate, and the like, colloidal silica particles such as TS530® and AEROSIL R972® available from Cabot Corporation and Degussa Chemicals, respectively, and metal oxides, such as titanium dioxide, preferably P25® ($TiO_2$) available from Degussa Chemicals and present in the important amounts indicated herein, and preferably present in an amount for each additive of about 0.4 weight percent with, in embodiments, 1 weight percent of the metal oxide particles being preferred.

Illustrative examples of carrier particles that can be selected for mixing with the toner compositions of the present invention include those particles that are capable of triboelectrically obtaining a charge of opposite polarity to that of the toner particles. Accordingly, the carrier particles can be selected so as to be of a positive polarity thereby enabling the toner particles, which are negatively charged, to adhere to and surround the carrier particles. Illustrative examples of known carrier particles that may be selected include granular zircon, steel, Hoeganese steel grit, nickel, iron, ferrites like copper zinc ferrites, available from Steward Chemicals, or Powder Tech., and the like. The carrier particles include thereon polymethylmethacrylate coating in an amount, that is coating weight of, for example, from about 0.50 to about 1.5 and preferably from about 0.75 to about 1 weight percent. The carrier coating includes therein conductive components like carbon black in an amount, for example, of from about 10 to about 40 weight percent and preferably about 20 weight percent. One carrier coating is comprised of 1 weight percent of polymethylmethacrylate with carbon black dispersed therein, and which carrier is prepared by solution coating of an 80/20 lacquer of the PMMA/carbon black, preferably VULCAN 72R® carbon black. Also, dry coating methods may be selected for the preparation of the carrier particles.

Also, while the diameter of the carrier particles can vary, generally they are of a diameter of from about 50 microns to about 1,000 microns, and preferably from about 50 to about 200 microns, thus allowing these particles to possess sufficient density and inertia to avoid adherence to the electrostatic images during the development process. The carrier particles can be mixed with the toner particles in various suitable combinations, such as from about 1 to about 3 parts per toner to about 50 parts to about 100 parts by weight of carrier.

The toner compositions of the present invention can be prepared by a number of known methods, including mechanical blending and melt blending the toner resin particles, pigment particles or colorants, and optional toner additives, followed by mechanical attrition including classification. The toner particles are usually pulverized and classified, thereby providing a toner with an average volume particle diameter of from about 7 to about 25, and preferably from about 7 to about 15 microns in average volume diameter as determined by a Coulter Counter. The toner compositions of the present invention are particularly suitable for preparation in a compounding extruder such as a corotating intermeshing twin screw extruder of the type supplied by the Werner & Pfleiderer Company of Ramsey, N.J. Subsequently, the toner surface additive mixture is included on the toner by, for example, the mixing of the toner and surface additives.

The toner and developer compositions of the present invention may be selected for use in developing images in electrostatographic imaging systems containing therein, for example, conventional photoreceptors, such as selenium and selenium alloys. Also useful, especially wherein there is selected negatively charged toner compositions, are layered photoresponsive imaging members comprised of transport layers and photogenerating layers, reference U.S. Pat. Nos. 4,265,990; 4,585,884; 4,584,253 and 4,563,408, the disclosures of which are totally incorporated herein by reference, and other similar layered photoresponsive devices. Examples of photogenerating layers include selenium, selenium alloys, trigonal selenium, metal phthalocyanines, metal free phthalocyanines, titanyl phthalocyanines, and vanadyl phthalocyanines, while examples of charge transport layers include the aryl amines as disclosed in U.S. Pat. No. 4,265,990, the disclosure of which is totally incorporated herein by reference. Moreover, there can be selected as photoconductors hydrogenated amorphous silicon, and as photogenerating pigments phthalocyanines, especially vanadyl phthalocyanine, titanyl phthalocyanines, especially Type IV, perylenes, especially BZP, and the like.

The following examples are provided, wherein parts and percentages are by weight unless otherwise indicated. A Comparative Example is also provided.

EXAMPLE I

A crosslinked unsaturated polyester resin can be prepared by the reactive extrusion process by melt mixing 99.3 parts of a linear unsaturated polyester with the following structure

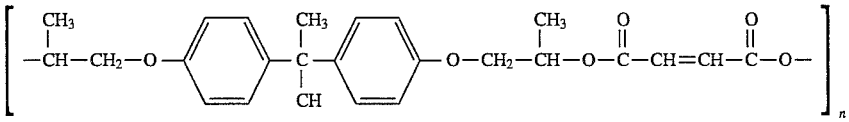

wherein n is the number of repeating units and having $M_n$ of about 4,000, $M_w$ of about 10,300, $M_w/M_n$ of about 2.58 as measured by GPC, onset $T_g$ of about 55° C. as measured by DSC, and melt viscosity of about 29,000 poise at 100° C. and about 750 poise at 130° C. as measured at 10 radians per second, and 0.7 part benzoyl peroxide initiator as outlined in the following procedure.

The unsaturated polyester resin and benzoyl peroxide initiator are blended in a rotary tumble blender for 30 minutes. The resulting dry mixture is then fed into a Werner & Pfleiderer ZSK-30 twin screw extruder, with a screw diameter of 30.7 millimeters and a length-to-diameter (L/D) ratio of 37.2, at 10 pounds per hour using a loss-in-weight feeder. The crosslinking is carried out in the extruder using the following process conditions: barrel temperature profile of 70/140/140/140/140/140/140° C., die head temperature of 140° C., screw speed of 100 revolutions per minute and average residence time of about three minutes. The extrudate melt, upon exiting from the strand die, is cooled in a water bath and pelletized. The product, which is crosslinked polyester, has an onset $T_g$ of about 54° C. as measured by DSC, melt viscosity of about 40,000 poise at 100° C. and about 150 poise at 160° C. as measured at 10 radians per second, a gel content of about 29 weight percent and a mean microgel particle size of about 0.1 micron as determined by transmission electron microscopy.

For characterization tests, the linear and crosslinked portions of the product are separated by dissolving the product in tetrahydrofuran and filtering off the microgel. The dissolved part is reclaimed by evaporating the tetrahydrofuran. This linear part of the resin, when characterized by GPC, is found to have $M_n$ of about 3,900, $M_w$ of about 10,100, $M_w/M_n$ of about 2.59, and onset $T_g$ of 55° C., which is substantially the same as the original noncrosslinked resin, which indicates that it contains no sol.

EXAMPLE II

A crosslinked unsaturated polyester resin is prepared by the reactive extrusion process by melt mixing 98.6 parts of a linear unsaturated polyester with the structure and properties described in Example I, and 1.4 parts benzoyl peroxide initiator as outlined in the following procedure.

The unsaturated polyester resin and benzoyl peroxide initiator are blended in a rotary tumble blender for 30 minutes. The resulting dry mixture is then fed into a Werner & Pfleiderer ZSK-30 twin screw extruder at 10 pounds per hour using a loss-in-weight feeder. The crosslinking is carried out in the extruder using the following process conditions: barrel temperature profile of 70/160/160/160/160/160/160° C., die head temperature of 160° C., screw rotational speed of 100 revolutions per minute and average residence time of about three minutes. The extrudate melt, upon exiting from the strand die, is cooled in a water bath and pelletized. The product which is crosslinked polyester has an onset $T_g$ of about 54° C. as measured by DSC, melt viscosity of about 65,000 poise at 100° C. and about 12,000 poise at 160° C. as measured at 10 radians per second, a gel content of about 50 weight percent and a mean microgel particle size of about 0.1 micron as determined by transmission electron microscopy.

For characterization, tests the linear and crosslinked portions of the product are separated by dissolving the product in tetrahydrofuran and filtering off the microgel. The dissolved part is reclaimed by evaporating the tetrahydrofuran. This linear part of the resin, when characterized by GPC, is found to have $M_n$ of about 3,900, $M_w$ of about 10,100, $M_w/M_n$ of about 2.59, and onset $T_g$ of 55° C. which is substantially the same as the original noncrosslinked resin, which indicates that it contains no sol.

EXAMPLE III

A toner was prepared by admixing in an extruder at about 125° C. 94 weight percent of the crosslinked polyester of Example I and with a gel content of 29, and 6 weight percent of REGAL 330® carbon black. Subsequently, the toner was classified to enable toner particles with an average particle volume diameter of 9 microns as determined by a Coulter Counter. Thereafter, there was added to the toner by mixing therewith in a jar mill with ⅛ inch diameter steel beads a mixture of surface additives of 0.4 weight percent of zinc stearate, and 0.4 weight percent of fumed silica TS530® obtained from Cabot Corporation.

About three (2.67 toner concentration) parts of the above prepared toner and 100 parts of carrier were blended to provide a developer. The carrier particles were comprised of a 98 micron Hoeganese unoxidized core solution coated with 1.06 weight percent of an 80/20 (80 weight percent, and 20 weight percent) lacquer of polymethylmethacrylate/VULCAN 72R® carbon black.

The toner triboelectric charge was a negative −15.8 microcoulombs per gram as determined by the known Faraday Cage method. The developer breakdown potential in volts was 59 and for detoned carrier the breakdown voltage was 26; the developer conductivity was $2.29\times10^{-8}$ $(\text{ohm-cm})^{-1}$ and $4.91\times10^{-6}$ $(\text{ohm-cm})^{-1}$ for detoned carrier as determined by a conductivity cell, reference U.S. Pat. No. 5,196,803, the disclosure of which is totally incorporated herein by reference. The developer conductivity sensitivity parameter alpha, and wherein alpha is [$\log_e$(carrier conductivity/developer conductivity)]/[toner concentration], was an excellent 2.01. The toner admix was 30 seconds as determined in the known charge spectrograph.

It is preferred that alpha be small, for example 5 or less, and more preferably 1 to about 3. The toner admix was less than 15 seconds as determined by the known charge spectrograph.

The same comparative developer without the above two surface additives had a tribocharge of −11.3 at 2.59 toner concentration, a tribo of −10.7 at a 2.67 toner concentration, a breakdown potential of 92 volts and 31 volts for detoned carrier, a developer conductivity of $2.20\times10^{-13}$ and $1.58\times10^{-7}$ $(\text{ohm-cm})^{-1}$ at a 2.59 toner concentration. Alpha was excessively high at 5.21 and the tribocharge admix spectrum was still bimodal after 1 minute, thus indicating a slow charge admix performance. Also, the same developer with only one surface additive of 0.4 percent of the TS530® had a tribocharge of −21 at 2.72 toner concentration, a tribo of −17.1 at 2.83 toner concentration, a breakdown potential of 101 volts and 25 volts for detoned carrier, a developer conductivity of $4.24\times10^{-14}$ and $3.90\times10^{-7}$ $(\text{ohm-cm})^{-1}$ at a 2.72 toner concentration. Alpha for this developer was a high undesirable value of 5.90, and the toner charge admix was slow, being incomplete even after one minute of mixing. Further, the same developer with one surface additive of zinc stearate, 0.4 weight percent, had a tribocharge of −7.3 at 2.37 toner concentration, a tribo of −6.9 at 2.32 toner concentration, a breakdown potential of 57 volts and 34 volts for detoned carrier, a developer conductivity of $4.32\times10^{-8}$ and $1.86\times10^{-6}$ $(\text{ohm-cm})^{-1}$ at a 2.37 toner concentration. Alpha was 1.59 and the toner charge admix was complete in less than 30 seconds.

EXAMPLE IV

A developer was prepared by repeating the process of Example III with the exception that the toner surface additive mixture was comprised of 0.4 weight percent of zinc stearate, 0.4 weight percent of AEROSIL R972® and 1 weight percent of titanium oxide ($TiO_2$) P25®. This developer had a tribocharge of −6.3 at a 2.54 toner concentration, a breakdown potential of 61 volts and 27 volts for detoned carrier, a developer conductivity of $1.1\times10^{-8}$ and $2.4\times10^{-6}$ $(\text{ohm-cm})^{-1}$ at a 2.54 toner concentration. Alpha was 2.10 and the admix was complete in 15 seconds.

EXAMPLE V

A developer was prepared by repeating the process of Example III with the exception that the toner surface additive mixture was comprised of 0.4 weight percent of zinc stearate, and 0.4 weight percent of AEROSIL R972®. This developer had a tribocharge of −10.3 at 2.75 toner concentration, a developer breakdown potential of 59 volts and 27 volts for detoned carrier, a developer conductivity of $2.5\times10^{-8}$ at a 2.75 toner concentration and $3.1\times10^{6}$ $(\text{ohm-cm})^{-1}$ for detoned carrier. Alpha was 1.75 and the admix was less than 15 seconds.

EXAMPLE VI

A developer was prepared by repeating the process of Example III with the exception that the toner surface additive mixture was comprised of 0.2 weight percent of zinc stearate, and 0.2 weight percent of silica TS530®. This developer had a tribocharge of −11.8 at 2.85 toner concentration, a developer breakdown potential of 72 volts and 26 volts for detoned carrier, a developer conductivity of $3.3\times10^{-9}$ at a 2.85 toner concentration and $2.5\times10^{-6}$ $(\text{ohm-cm})^{-1}$ for detoned carrier. Alpha was 2.33 and the admix was less than 15 seconds.

Other modifications of the present invention may occur to those skilled in the art subsequent to a review of the present application. The aforementioned modifications, including equivalents thereof, are intended to be included within the scope of the present invention.

What is claimed is:

1. A developer composition consisting essentially of negatively charged toner particles consisting essentially of crosslinked polyester resin particles, pigment particles, and a surface additive mixture comprised of metal salts of fatty acids in an amount of from about 0.2 to about 0.5 weight percent, metal oxide particles in an amount of from about 0.3 to about 1 weight percent, and nonmetallized silica particles in an amount of from about 0.2 to about 0.5 weight percent; and carrier particles comprised of a core with a coating thereover containing a conductive component.

2. A developer composition comprised of negatively charged toner particles comprised of crosslinked polyester resin particles, carbon pigment particles, and a surface additive mixture comprised of metal salts of fatty acids in an amount of from about 0.3 to about 0.4 weight percent, titanium oxide particles in an amount of from about 0.3 to about 1 weight percent, and nonmetallized fumed silica particles in an amount of from about 0.3 to about 0.4 weight percent, and carrier particles comprised of a core with a polymer coating thereover containing a conductive component.

3. A developer in accordance with claim 2 wherein 0.4 weight percent of said metal salt and said silica are present and 1 weight percent of said titanium oxide particles are present.

4. A developer in accordance with claim 2 wherein the metal salt is zinc stearate.

5. A developer in accordance with claim 2 wherein the polyester possesses a gel content of from about 25 to about 34 weight percent.

6. A developer in accordance with claim 2 wherein the polyester possesses a gel content of about 29 weight percent.

7. A developer in accordance with claim 2 wherein the polyester is generated from the condensation reaction of dimethylterephthalate, 1,2-propanediol, 1,3-butanediol, and pentaerythritol; or wherein the polyester results from the condensation reaction of dimethylterephthalate, 1,2-propanediol, diethylene glycol, and pentaerythritol.

8. A developer in accordance with claim 3 wherein said metal salt is zinc stearate.

9. A developer in accordance with claim 2 wherein the carrier core is steel.

10. A developer in accordance with claim 2 wherein the carrier particles have a diameter of from about 75 to about 110 microns.

11. A developer in accordance with claim 2 wherein the carrier particles have a diameter of about 98 microns.

12. A developer in accordance with claim 2 wherein the coating is comprised of polymethylmethacrylate.

13. A developer in accordance with claim 2 wherein the conductive component is carbon black.

14. A developer in accordance with claim 2 wherein the conductive component is carbon black present in an amount of from about 20 to about 40 weight percent.

15. A developer in accordance with claim 2 with a conductivity of from about $10^{-8}$ to about $10^{-12}$ (ohm-cm)$^{-1}$.

16. A developer in accordance with claim 2 with a conductivity of $10^{-8}$ (ohm-cm)$^{-1}$.

17. A developer in accordance with claim 2 with a toner triboelectric charge of from about a negative 6 to a negative 12 microcoulombs per gram.

18. A developer in accordance with claim 2 with 0.4 weight percent of zinc stearate, and 0.4 weight percent of silica, and 1 weight percent of the metal oxide particles titanium dioxide; and wherein the carrier particles are comprised of a steel core with a polymethylmethacrylate coating containing dispersed therein a conductive carbon black, and the polyester has a gel content of from about 25 to about 33 percent.

19. A developer in accordance with claim 18 wherein the polyester gel content is 29 percent.

20. A developer in accordance with claim 12 wherein the polymethylmethacrylate coating weight is present in an amount of from about 0.75 to about 1 weight percent.

21. A developer in accordance with claim 12 wherein the polymethylmethacrylate coating weight is from about 1 to about 1.5 weight percent.

22. A developer composition comprised of negatively charged toner particles comprised of crosslinked polyester resin particles, carbon black pigment particles in an amount of from about 4 to about 8 weight percent, and a surface additive mixture comprised of zinc stearate in an amount of from about 0.3 to about 0.4 weight percent, nonmetallized silica particles in an amount of from about 0.3 to about 0.4 weight percent, and titanium oxide particles present in an amount of form about 0.7 to about 1 weight percent, and carrier particles comprised of a core with a polymethylmethacrylate polymer coating thereover containing a carbon black conductive component.

23. A developer composition in accordance with claim 22 wherein the surface additive mixture is comprised of zinc stearate in an amount of about 0.2 weight percent, nonmetallized fumed silica particles in an amount of about 0.2 weight percent and titanium oxide particles in an amount of about 1 weight percent.

24. A method for obtaining images which comprises generating an electrostatic latent image on a photoconductive imaging member, subsequently affecting development of this image with the developer composition of claim 1, thereafter transferring the image to a permanent substrate, and permanently affixing the image thereto.

25. An imaging method which comprises generating an electrostatic latent image on a layered photoconductive imaging member, subsequently affecting development of this image with the toner composition of claim 2, thereafter transferring the image to a permanent substrate, and permanently affixing the image thereto.

26. A method which comprises generating an electrostatic latent image on a layered photoconductive imaging member, subsequently affecting development of this image with the toner composition of claim 22, thereafter transferring the image to a permanent substrate, and permanently affixing the image thereto.

27. A developer composition consisting of negatively charged toner particles consisting of crosslinked polyester resin particles, carbon black pigment particles, and a surface additive mixture consisting of metal salts of fatty acids in an amount of from about 0.3 to about 0.4 weight percent, titanium oxide particles in an amount of from about 0.3 to about 1 weight percent, and nonmetallized fumed silica particles in an amount of from about 0.3 to about 0.4 weight percent; and carrier particles comprised of a core with a polymer coating containing therein a conductive component, which conductive component is present in an amount of from about 20 to about 50 weight percent.

28. A developer in accordance with claim 27 wherein the carrier core is comprised of an oxidized steel and the coating thereover contains polymethylmethacrylate/carbon black in an amount of 80 weight percent of said polymethylmethacrylate and 20 weight percent of said carbon black.

29. A developer composition consisting of negatively charged toner particles consisting of crosslinked polyester resin particles, pigment particles, and a surface additive mixture comprised of metal salts of fatty acids in an amount of from about 0.2 to about 0.5 weight percent, metal oxide particles in an amount of from about 0.3 to about 1 weight percent, and silica particles in an amount of from about 0.2 to about 0.5 weight percent; and carrier particles comprised of a core with a coating thereover containing a conductive component.

* * * * *